United States Patent [19]

Eskew et al.

[11] 4,383,777

[45] May 17, 1983

[54] TORQUE-LIMITING CARRIAGE RETURN KNOCK-OFF MECHANISM

[75] Inventors: Douglas H. Eskew; Raymond M. Marowski; Danny R. Sevy, all of Lexington, Ky.

[73] Assignee: International Business Machines Corporation, Armonk, N.Y.

[21] Appl. No.: 163,841

[22] Filed: Jun. 27, 1980

[51] Int. Cl.[3] ..... B41J 19/70

[52] U.S. Cl. ..... 400/314.6; 400/317.2; 400/317.3

[58] Field of Search ..... 400/314.6, 317–317.3; 242/75, 67.1 R, 147 R

[56] References Cited

U.S. PATENT DOCUMENTS

| | | | |
|---|---|---|---|
| 909,539 | 1/1909 | Burlingame | 400/314.1 |
| 1,386,387 | 8/1921 | Waldheim | 400/314.3 |
| 2,647,609 | 8/1953 | Sagner | 400/314.6 |
| 2,700,513 | 1/1955 | Miles | 242/75.5 |
| 3,263,793 | 8/1966 | Brignole | 400/314.2 |
| 3,661,338 | 5/1972 | Becking | 242/67.1 R |

OTHER PUBLICATIONS

*IBM Customer Engineering Manual,* 241-5159-2, 1965, pp. 57–58, 400–317.3.

*Primary Examiner*—Paul T. Sewell
*Attorney, Agent, or Firm*—Laurence R. Letson

[57] ABSTRACT

A carriage return device utilizing a spring clutch and shock unloader spring is disclosed in conjunction with a cord tension sensing mechanism for detecting the cord tension increases when the paper carriage of a typewriter ceases to move and the carriage return drive mechanism continues to operate. It is desirable to disengage the drive mechanism at that point rather than to cause frictional wear or overloading of the motor pending a predetermined amount of driving time prior to disengagement. Upon the cord tension reaching a preset value, the clutch pawl will disengage the drive clutch and prevent further wear of the clutching arrangement. To prevent premature disengagement of the clutch, a shock unloading pretensioned spring is incorporated in the drive unit to absorb the initial shocks of clutch engagement and the forces experienced during acceleration of the paper carriage.

7 Claims, 6 Drawing Figures

TORQUE-LIMITING CARRIAGE RETURN KNOCK-OFF MECHANISM

BACKGROUND OF THE INVENTION

This invention relates to cord winding devices and more particularly to carriage returns on printers or typewriters.

Moving paper carriage printers and typewriters have, in the past, utilized carriage returns in the form of power driven cord reels or tape drums depending on the force transmission member chosen. Patents which deal with the release or the termination of operation of the carriage return drive mechanism include U.S. Pat. Nos. 909,539 to Burlingame, 1,386,387 to Waldheim, 2,647,609 to Sagner and 3,263,793 to Brignole, Jr. U.S. Pat. No. 909,539 is exemplary of a device where the electrical motor power for the carriage return mechanism is interrupted by a mechanical movement caused by the engagement of the left margin stop on the carriage with a follower to effectively break the electrical circuit.

Waldheim discloses a device which is tension governed such that upon the completion of the carriage return movement, the cord tension overcomes spring forces sufficient to pull an electrical switch contact apart, thus preventing further driving by the electrical motor.

Sagner, U.S. Pat. No. 2,647,609, utilizes a mechanical stop member as does Brignole, Jr., 3,263,793, to disengage the driving clutches as a result of the engagement of a knock-off latch by a carriage return stop.

With the exception of the Waldheim reference, all three other references require the carriage return to be returned to the leftmost position on the print line to engage the margin stop with the knock-off mechanism. This requires a complete carriage return and does not allow for carriage jams or other inadvertent blocking of the carriage return and could then cause a burning of the clutch, overloading of the motor, or a breakage of parts. Waldheim permits the disengagement of the motor upon the overcoming of the spring tensions by the carriage return tape. The Waldheim device will, of necessity, require sufficient spring tensions in the spring holding the switch closed to prevent a premature disconnection of the motor contacts. This will, of course, accommodate high initial cord tension and also very high cord tensions in order to accomplish the disconnecting of the motor upon the completion of the carriage return.

All of the above references would require a very substantially sized motor in order to overcome the acceleration forces during the initial phase of carriage return and generate adequate forces to terminate carriage drive.

OBJECTS OF THE INVENTION

It is an object of the invention to automatically disengage the carriage return clutch whenever the carriage return cord tension exceeds a preselected value.

It is another object of the invention to automatically disengage the carriage return clutch whenever the carriage has reached its normal limit of travel or ceases to move, thus raising the carriage return cord tension past a predetermined level.

It is another object of the invention to absorb initial acceleration loadings to prevent premature disengagement of the carriage return clutch.

It is still a further object of the invention to absorb initial loadings and eliminate peak forces to reduce the requirement for motor size on the carriage return function.

It is still another object of this invention to smooth out and minimize the variations in the carriage return velocity.

The shortcomings of the prior art are overcome and the objects of the invention are accomplished by the incorporation into the carriage return clutch module of a shock unloader prestressed spring member, which also acts as a resilient torque transmission member, and a cord tension responsive latch control to disconnect the clutch and allow the clutch to disengage upon the reaching of some predetermined cord tension value. The carriage return control module includes a coil spring torque transmission member which is pretensioned to absorb the initial forces necessary to accelerate the carriage. After the forces have been absorbed, the driving hub of the carriage return control is then resiliently coupled to the driving arbor and continues to rotate the arbor. The shock absorbing capacities insure (1) that a smaller motor may be utilized inasmuch as peak loads are diminished and (2) that the cord tension sensing knock-off control is not inadvertently activated early in the operational cycle prior to a complete carriage return operation being accomplished. The cord tension sensing device is moved when the cord tension reaches a predetermined threshold and then, through linkages, unlatches or disengages the clutch pawl from the clutch lug, thereby allowing the controlled spring clutch to relax and disengage the driven arbor and the cord drum.

A more complete understanding of the function, structure and operation of the carriage return control may be had from the accompanying drawings and the detailed description to follow.

DESCRIPTION OF THE INVENTION

Figure 1:
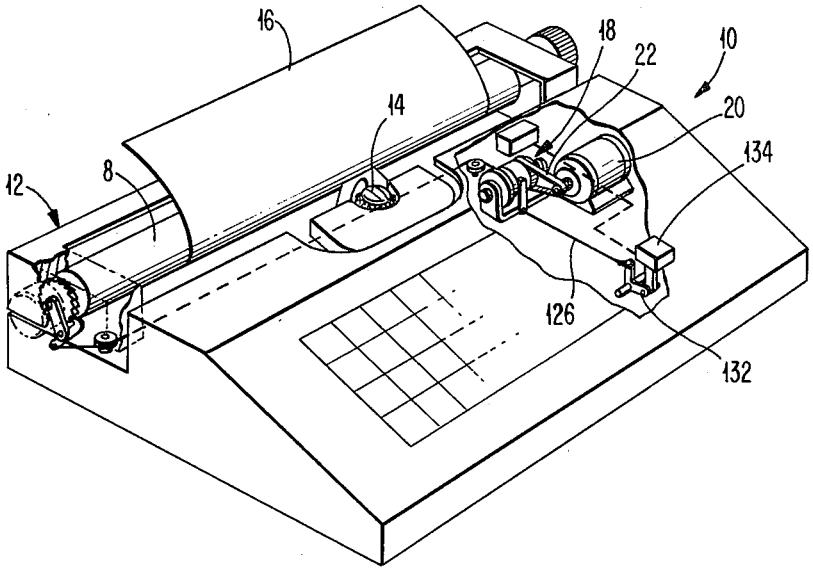
FIG. 1 illustrates a typewriter having a moving carriage and a carriage return mechanism as described in the remainder of the figures.

Referring to FIG. 1, typewriter 10 is the type of typewriter where the moving paper carriage 12 translates past the print element 14 to define a writing line on the page 16. The movement of carriage 12 is in a leftward direction, thus displacing the print point along the writing line on page 16 toward the right, in an escapement operation. The mechanisms by which that is accomplished form no part of this invention and, therefore, are not included in the drawings.

In order to translate carriage 12 toward the right, thereby repositioning the print point at the left end of the print line, a carriage return mechanism 18 is disclosed in the right portion of typewriter 10. Carriage return mechanism 18 is powered by drive motor 20 by timing belt 22.

Figure 2:
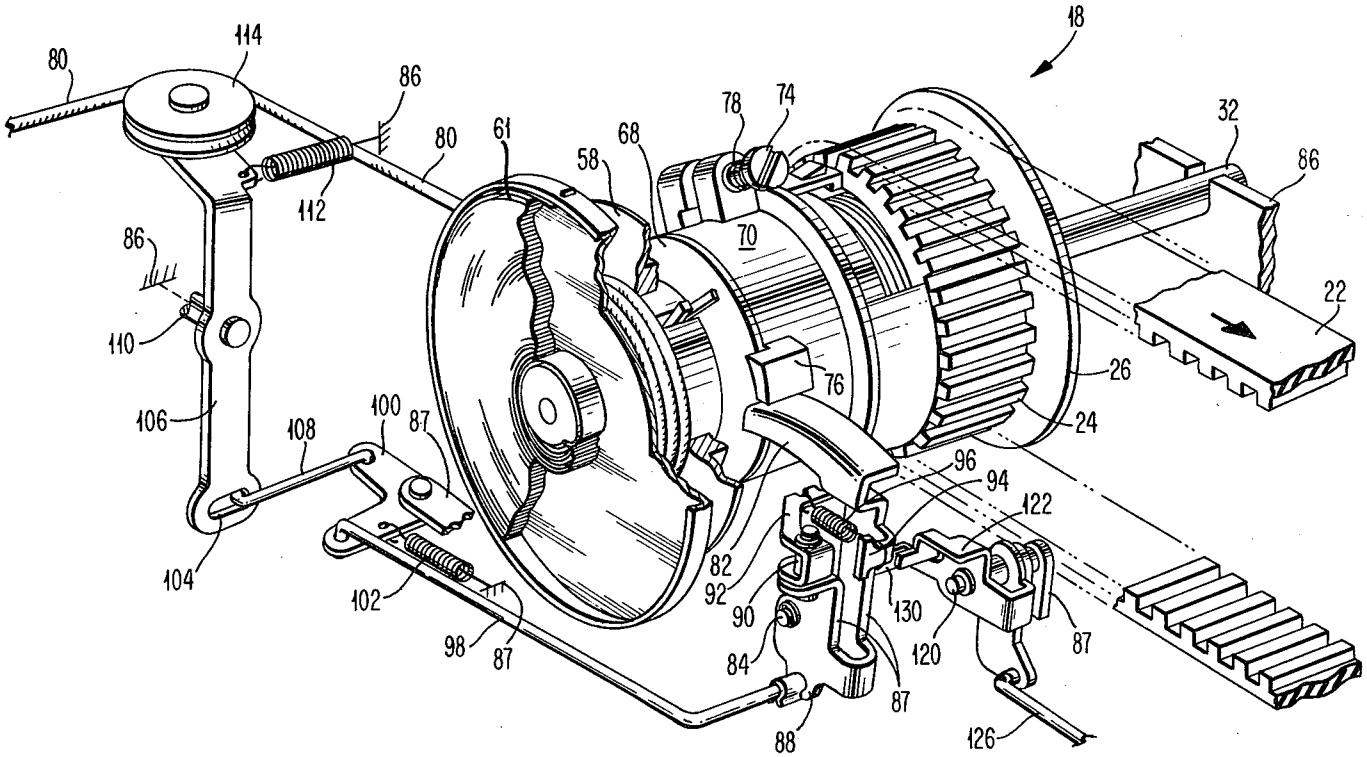
FIG. 2 illustrates the carriage return drive and control apparatus in its assembled state.
Figure 5:
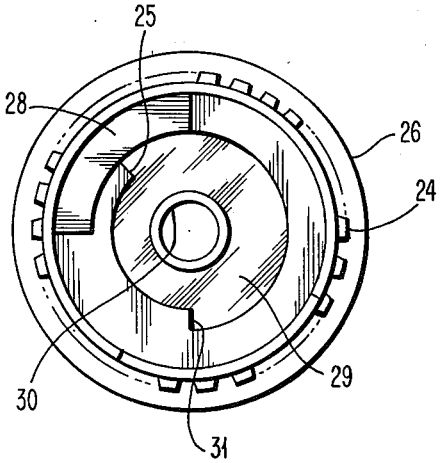
FIG. 5 illustrates the interior of the hub driven by the drive belt.

Referring to FIG. 2, timing belt 22 is wrapped around and engages timing gear 24. Timing gear 24 is conveniently molded into the periphery of a drive hub 26. Further detail as to the internal construction of hub 26 is found in FIGS. 3 and 5. Hub 26 is provided with a raised partial annular member 28 on the interior of the cavity of hub 26. Further, hub 26 is provided with a bearing surface 30 for engagement with shaft 32. Depressed into interior end face of hub 26 is a relief 29 to accommodate the end of arbor 36 and provide driving surface 31 engageable with rim 37.

Figure 3:
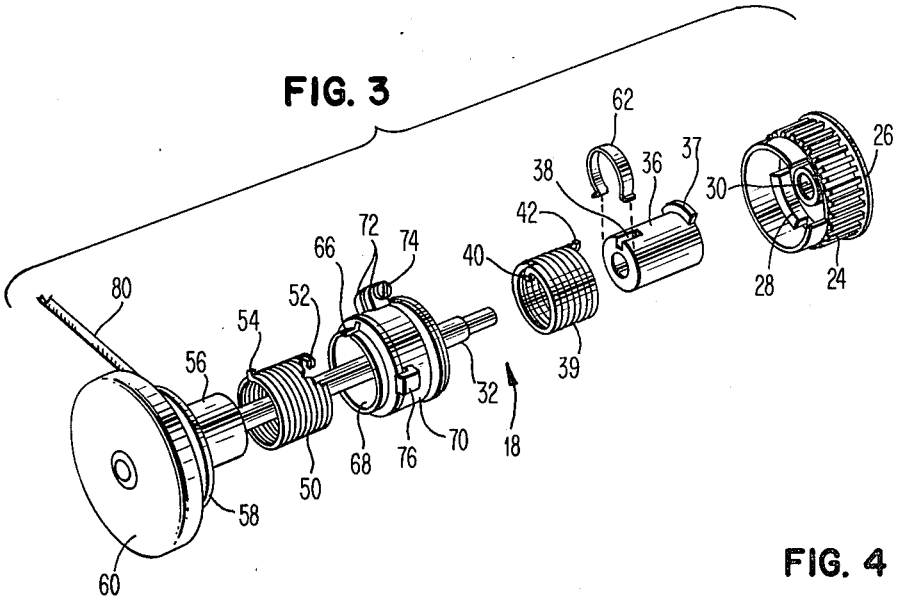
FIG. 3 is an exploded view of the components of the carriage return apparatus displaced from each other for clarity.

Further referring to FIG. 3, extending through the central axis of the carriage return control module 18 is shaft 32 which further acts to support and provide the axis of rotation for component parts of the module as well as a mounting means with respect to the typewriter frame 34 shown on the right end of shaft 32 in FIG. 2. Surrounding shaft 32 is arbor 36. Arbor 36 is provided with a channel or groove 38 formed in the cylindrical periphery thereof and at one end.

At the opposite end of arbor 36 is a partial annular protruding rim 37 extending outward from the cylindrical surface of arbor 36. This rim 37 is dimensioned to fit into the interior of hub 26. It is also dimensioned to engage surface 31 which is formed into the interior of hub 26. Rim 37 and surface 31 will engage one or the other end thereof when hub 26 is rotated with respect to arbor 36 and, thus, become a solid driving connection. When the other or opposite end of rim 37 is engaged with surface 25, it becomes a stop surface which prevents arbor 36 from rotating in the biased direction.

Surrounding arbor 36 is resilient torque transmission member with form of a coil spring 39 having two end tangs 40 and 42. Tang 40 is inwardly disposed to engage in and be trapped by slot 38. Tang 42 is outwardly disposed to be engaged by and driven by the interior surfaces of hub 26, specifically the end of 28.

Also concentric with shaft 32 is clutch spring 50 having inwardly disposed tang 52 and outwardly disposed tang 54. Tang 52 is engaged with slot 38 for purposes of deriving motion from the rotation of arbor 36. As arbor 36 is rotated, clutch spring 50 will be rotated about its axis and freely about arbor 56 which is rotationally mounted on shaft 32. Shaft 32 extends freely through arbor 56, cord drum 58 and clock spring housing 60. Clock spring housing 60 contains a clock spring 61 illustrated in FIG. 2 which will act to spring bias the cord drum 58. Cord drum 58 and arbor 56 are fixedly attached to each other to provide a driving relationship between arbor 56 and drum 58. In order to retain spring 50 with inwardly disposed tang 52 engaged with slot 38 of arbor 36, spring clip 62 is engaged with the outer periphery of clutch spring 50. Spring clip 62 grasps the outer cylindrical surface of clutch spring 50 and retains it frictionally on arbor 36. A supplemental function of clip 62 is to also contain on the arbor 36 resilient torque transmission member 39, thus preventing it from sliding axially off the arbor 36. Resilient torque transmission member 39 performs a shock unloading function to absorb and subsequently unload the shock of initial acceleration forces.

Spring 50 has an upwardly or outwardly extending tang 54 engageable with tang slot 66. Tang slot 66 is formed into clutch sleeve 68. Clutch sleeve 68 has on its exterior a cylindrical surface into which slip ring 70 is engaged. Slip ring 70 is further provided with lug 72 through which a screw 74 is threadedly engaged. Screw 74 may be provided with a spring 78 coaxial therewith as better illustrated in FIG. 2. Screw 74 and spring 78 in conjunction with slip ring 70 provides a tensioning or frictional adjustment. Slip ring 70 carries clutch lug 76 on its periphery. Clutch spring 50 is contained within the interior of clutch sleeve 68. Clock spring housing 60 contains a clock spring 61 which will be wound during the normal operation of the paper carriage in moving from right to left during printing and spacing escapements. The clock spring thus is wound to insure that a tension sufficient to prevent slack is maintained on carriage return cord 80 at all times.

Figure 4:
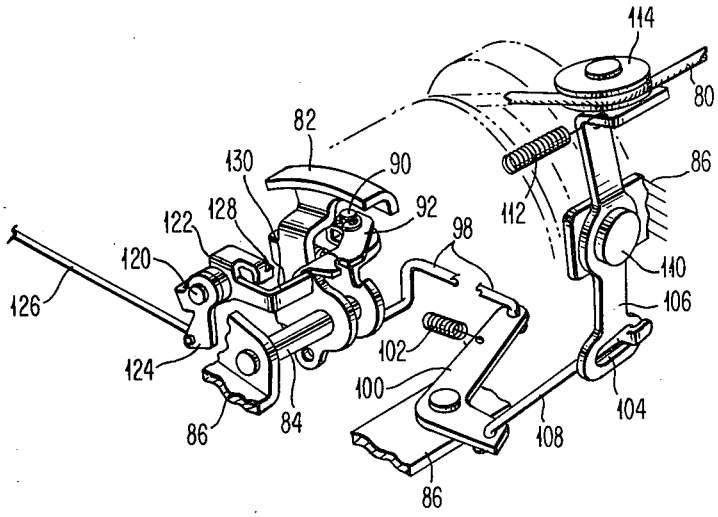
FIG. 4 illustrates the cord tension sensing mechanism found in FIG. 2 from the opposite side and generally illustrates its relationship to the carriage return module.

Referring to FIGS. 2 and 4, FIG. 4 being a perspective view of the clutch latch control from the opposite direction of that illustrated in FIG. 2, and with the carriage return control module removed for visibility sake, a clutch pawl 82 is provided in proximity to the periphery of slip ring 70 which frictionally engages the exterior of clutch slip ring 68. Sleeve 70 carries clutch lug 76 which extends outwardly therefrom, and clutch pawl 82 is positioned to be insertable into the path of lug 76 as illustrated in FIG. 2.

Clutch pawl 82 is pivotally supported on support pin 84 which is shown mounted on the typewriter frame 86 in FIG. 4. Typewriter frame 86 in FIG. 4 is not similarly illustrated in FIG. 2 for visibility. Clutch pawl 82 is formed as a single piece member or bellcrank and is further comprised of a main body section 87 and a lower arm 88. Extending from the main body section 86 is a pivotal support member 90 which carries on it in a pivotal fashion latch pawl 92. Main body section 87 of clutch pawl 82 further has a spring retainer 94 for mounting a tension spring 96 between spring retainer 94 and pawl 92. Pawl 92 is normally biased by spring 96 into engagement with its adjacent face of main body section 87 of clutch pawl 82.

To provide movement for clutch pawl 82, link 98 is engaged with the lower arm 88 of clutch pawl 82. Link 98, on its opposite end, is connected into a bellcrank 100 which is in turn spring biased by tension spring 102 attached to typewriter frame 86. Under the influence of spring 102, link 98 will provide a normal biasing force toward engagement of pawl 82 into the path of lug 76.

Movement of bellcrank 100 is permitted due to the motion slot 104 in pulley arm 106. Connecting link 108 is engaged with lost motion slot 104 and bellcrank 100, thus permitting a limited amount of movement of link 108 and bellcrank 100 without encountering the resistance of pulley arm 106. Pulley arm 106 is attached likewise to the typewriter frame 86 by means of fulcrum pin 110 and biased with respect to the typewriter frame 86 by a tension spring 112.

Mounted on arm 106 as a cord direction change means is pulley 114. Pulley 114 acts to direct the carriage return cord 80 in a direction perpendicular to the plane of the cord takeup spool 58.

Referring to FIGS. 2 and 3, link 108 is illustrated in the position where clutch pawl 82 has engaged lug 76 in order to cause engagement of clutch spring 50 with arbor 56 of FIG. 3 and the cord tension in cord 80 has not risen to the point sufficient to displace pulley 114 against the force of spring 112 and thus rotate arm 106 in a counterclockwise direction as in FIG. 2.

FIG. 4 illustrates this same linkage in a position where the pulley 114 has been translated rightwardly by cord tension sufficient to cause the lost motion slot 104 to engage in a forcible connection with link 108.

Referring to FIGS. 2 and 4, with particular attention to FIG. 4, pivot pin 120, supported on frame 86 pivotally supports trigger mechanism 122. Trigger 122 is in the form of a bellcrank having one arm 124 engaged by a link to the keyboard 126. Two other separate arms of the bellcrank 128 and 130 are also formed thereon. Arms 128 and 130 serve as latch surfaces for engagement with the tip of pawl 92.

Link 126 extending toward the front of the typewriter 10 is connected to bellcrank 132 which in turn may be oscillated by carriage return button 134 shown in FIG. 1. The movement of keybutton 134 is thus transferred through bellcrank 132 and link 126 to trigger bellcrank 122. As trigger mechanism 122 is oscillated in FIG. 4 in a clockwise direction in response to carriage return button 134 and its depression, the arms 130 and 128 will be moved downward. The movement of arm 130 downward will cause it to disengage from the tip of latch pawl 92 thus allowing spring 102 to move the bellcrank 100, link 98 and clutch pawl 82 in such a direction as to engage clutch pawl 82 with lug 76 on the slip ring 70 upon its next revolution. This will effectively engage the carriage return clutch control mechanism 18 to begin to effect the drawing in of carriage return cord 80 and the shifting of carriage 12 rightward as depicted in FIG. 1.

Pawl 92 will remain disengaged from arm 130 so long as the carriage return mechanism is operative. Upon the completion of the carriage return, the action of pulley 114 under the increasing tension cord 80 will cause the arm 106 in FIG. 4 to rotate in a clockwise direction effecting a pulling on link 98 through link 108 and bellcrank 100 and a counterclockwise rotation of clutch pawl 82 about its support shaft 84. As it is retracted, pawl 92 is retracted along with pawl 82. In the event that the carriage return button has been released, pawl 92 will engage arm 130 and will cam away from pawl 82 until it has been adequately withdrawn for pawl 92 to clear arm 130 and reposition itself against pawl 82.

Upon the relaxation of the cord tension due to the disengagement of the clutch by withdrawal of pawl 82, spring 112 will act to relieve forcible engagement of lost motion slot 104 against link 108 permitting spring 102 to move pawl 82 generally toward engagement. As pawl 92 reengages arm 130, pawl 82 will be stopped. Arm 128 is provided so that in the event the operator's finger remains on the carriage return key 134 and link 126 remains displaced such that arm 130 is not in a position to reengage pawl 92, arm 128 is capable of trapping pawl 92. Upon the restoration of bellcrank 122 to its normal at rest position, arm 128 will disengage by rotating out of engagement with pawl 92 and permit pawl 92 to engage arm 130 in preparation for the next operation.

Should the operator desire a repeat index function after the normal carriage return, carriage return key 134 may be further depressed to prevent both arm 130 and 128 from engaging pawl 92 upon its return and, therefore, allow clutch pawl 82 to again reengage clutch lug 76. By doing this, the cord tension will be increased and with the carriage return cord 80 engaged with the line feed mechanism as is highly conventional, the platen 8 on carriage 12 will be indexed through a line feed movement and then the cord tension will increase to again disable the clutch through the tension sensing control.

A typical sequence of operations for this device would be for the operator to depress the carriage return key 134. Depression of the carriage return key 134 will effect translational movement of link 126, thereby rotating bellcrank 122 to displace arm 130 downward and thus disengage pawl 92. As arm 130 is depressed and disengages pawl 92, clutch pawl 82 will move inward toward engagement with lug 76, a condition illustrated in FIG. 2. This movement of the clutch pawl 82 is effected by the force exerted by spring 102 on bellcrank 100. As lug 76 engages pawl 82, the outer sleeve 70 stops rotating and the friction between slip ring 70 and clutch sleeve 68 sufficient to at least momentarily stop clutch sleeve 68. As sleeve 68 stops, slot 66 will act to prevent further rotation of tang 54 of clutch spring 50. Clutch spring 50 will then begin to wrap down onto arbor 56. As clutch spring 50 engages the periphery of arbor 56 and attempts to rotate cord drum 58, a resistance is encountered by the drive chain of parts comprising hub 26, shock spring 39, arbor 36, clutch spring 50 and arbor 56. As this resistance to movement is transferred from arbor 56 back through the chain of drive, hub 26 will continue to rotate under the influence of drive belt 22 in a clockwise direction as shown in FIG. 3. This movement will continue and will act to wind spring 39 through the action of member 28 on tang 42. As this energy is stored, a portion of the energy is transmitted by tang 40 to arbor 36 for further driving of the carriage return drive. The initial shocks are absorbed by spring 39, thus preventing a high tension in cord 80 during the portion of operation where carriage 12 is being accelerated.

At the time that the carriage 12 completes its return movement and stop surface 31 within the interior of hub 26 engages the end of rim 37, thus forming a solid drive connection for further driving of the arbor 36.

Sleeve 70 having lug 76 formed as a part thereof is provided with an adjustment means primarily two lugs 72 and adjusting screw 74 coupled with spring 78. This device provides a means for controlling the frictional drag between the slip ring 70 extending around sleeve 68. This arrangement permits sleeve 68 to rotate after clutch spring 50 has fully wrapped down onto arbor 56 and it is necessary for clutch spring 50 to continue to rotate.

Figure 6:
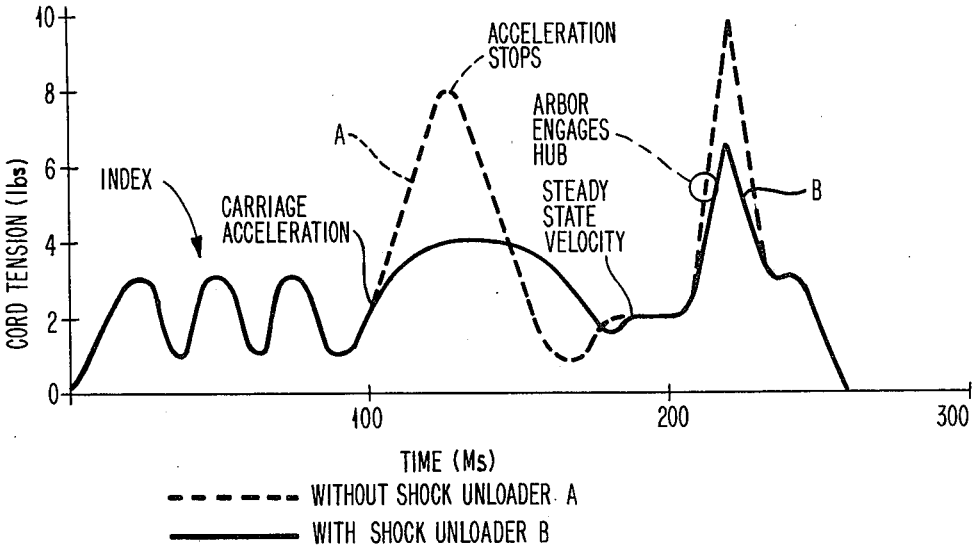
FIG. 6 is a graph depicting the cord tension experienced in a carriage return system with and without a shock unloader in the system.

FIG. 6 illustrates a typical cord tension versus time graph showing on curve A the peaks encountered during acceleration, where the shock absorbing spring member 38 is not found in the mechanism and where there is a direct drive from the hub 26 to arbor 36.

Curve B illustrates the effect of putting the shock absorbing torque transmission member 38 between drive hub 26 and arbor 36 and the absorbing of the initial acceleration peaks. The cord tension necessary to release the clutch pawl 82 from engagement with lug 76 and allow disengagement of the clutch spring 50 from arbor 56 may be controlled by the strength of spring 112. It is highly advantageous to limit the amount of force required to extend spring 112 to the minimum necessary for reliable function.

The predetermined cord tension necessary to operate the pulley arm 106 and thus the trigger 122 to disengage the clutch spring 50 is sized to exceed the tensions experienced during acceleration but as low as reliable. Spring 112 is the controlling factor in setting the predetermined cord tension.

Therefore, it is also desirable to limit the cord tension during the initial acceleration phase of operation, thereby reducing the chances of mechanical wear and failure due to cord breakage or overloading of the clutch mechanism. Additionally, by reducing the necessary cord tension during the acceleration phase, a lower knock-off cord tension may be utilized, thus reducing the load on the motor.

It is also highly beneficial to the operation of the carriage return control and function that the shock unloader spring 39 further acts to dampen the oscillations in the velocity of the carriage 12 during carriage return, since this allows the drive motor 20 to operate under a smoother load and permits a better design of the machine, having predictable timing.

We claim:

1. In a typewriter with a moving paper carriage, a carriage return mechanism for returning said carriage to a line beginning position, said carriage return mechanism comprising:

a carriage return cord;

a carriage return cord drum having said carriage return cord attached at one end thereof to said drum;

a first arbor, said arbor attached to said carriage return cord drum in driving relationship;

a normally disengaged clutch spring engageable with said arbor;

a second arbor, said clutch spring attached to and driven by said second arbor;

clutch control means for engaging and disengaging said clutch with and from said first arbor;

carriage return cord tension sensing means coupled to said clutch control means and responsive to predetermined cord tensions for operating said clutch control means;

a drive input means;

a deformable resilient torque transmission means interconnecting said drive input means and said second arbor for transmitting the motion of said input means to said second arbor, while allowing limited relative movement therebetween, and for absorbing loads during deformation, thereby preventing peak initial carriage return cord tensions from prematurely operating said clutch control means.

2. The carriage return mechanism as claimed in claim 1 wherein said cord tension sensing means further comprises spring biased lever operatively associated with said clutch control means, said spring biased lever displaceable by said cord tension acting thereon.

3. The carriage return mechanism of claim 2 wherein said operative association is comprised of a linkage connected to said clutch control means and said lever comprises a lost motion connection engaged with said linkage.

4. The carriage return mechanism of claim 1 wherein said resilient torque transmission means comprises a coiled spring.

5. The mechanism of claim 4 wherein said coil spring is prestressed to a predetermined level.

6. The mechanism of claim 1 wherein said drive input means is drivingly engageable directly with said second arbor after said drive input means has equalled said limited relative motion with respect to said second arbor, to create a solid driving connection.

7. In a typewriter with a moving paper carriage, a carriage return mechanism for returning said carriage to a line beginning position, said carriage return mechanism comprising:

a carriage return cord;

a carriage return cord drum having said carriage return cord attached at one end thereof to said drum;

a clutch means;

a clutch control means for engaging and disengaging said clutch means with and from said carriage return cord drum;

carriage return cord tension sensing means coupled to said clutch control means and responsive to predetermined cord tensions for operating said clutch control means;

a drive input means;

a deformable resilient torque transmission means interconnecting said drive input means and said clutch means for transmitting the motion of said input means to said clutch means, while allowing limited relative movement therebetween, and for absorbing loads during deformation, thereby preventing peak initial carriage return cord tensions from prematurely operating said clutch control means.

* * * * *